US007626555B2

(12) United States Patent
Kalliokoski et al.

(10) Patent No.: US 7,626,555 B2
(45) **Date of Patent: *Dec. 1, 2009**

(54) ANTENNA ARRANGEMENT AND METHOD FOR MAKING THE SAME

(75) Inventors: Ari Kalliokoski, Kello (FI); Antti Lilja, Oulunsalo (FI); Mika Maarala, Oulu (FI)

(73) Assignee: Nokia Corporation, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/152,055

(22) Filed: May 12, 2008

(65) Prior Publication Data

US 2008/0218420 A1 Sep. 11, 2008

Related U.S. Application Data

(63) Continuation of application No. 10/878,239, filed on Jun. 28, 2004, now Pat. No. 7,372,411.

(51) Int. Cl.
*H01Q 1/24* (2006.01)

(52) U.S. Cl. ..... 343/702

(58) Field of Classification Search ..... 343/702, 343/700 MS, 793–795, 850, 860
See application file for complete search history.

(56) References Cited

U.S. PATENT DOCUMENTS

| | | | | |
|---|---|---|---|---|
| 4,623,893 | A * | 11/1986 | Sabban | 343/700 MS |
| 5,121,127 | A * | 6/1992 | Toriyama | 343/700 MS |
| 5,444,453 | A * | 8/1995 | Lalezari | 343/700 MS |
| 5,450,090 | A | 9/1995 | Gels et al. | |
| 5,526,003 | A | 6/1996 | Ogawa et al. | |
| 5,568,155 | A | 10/1996 | Tsunekawa et al. | |
| 5,631,660 | A | 5/1997 | Higashiguchi et al. | |
| 5,684,492 | A | 11/1997 | Kagoshima et al. | |
| 5,818,398 | A | 10/1998 | Tsuru et al. | |
| 5,861,854 | A | 1/1999 | Kawahata et al. | |
| 6,049,314 | A | 4/2000 | Munson et al. | |
| 6,252,552 | B1 | 6/2001 | Tarvas et al. | |

(Continued)

FOREIGN PATENT DOCUMENTS

| | | |
|---|---|---|
| EP | 1067627 | 1/2001 |

OTHER PUBLICATIONS

Abedin et al., Modifying the ground plane and its effect on planar inverted-F antennas (PIFAs) for mobile phone handsets, IEEE Antennas and Wireless Propagation Letters, vol. 2, 2003, p. 226-229.

(Continued)

*Primary Examiner*—Huedung Mancuso
(74) *Attorney, Agent, or Firm*—Hollingsworth & Funk, LLC

(57) ABSTRACT

An inverted-F antenna arrangement comprising a dielectric element structure, a radiating element on the dielectric element, the radiating element having a first end and a second end, a planar ground element, the dielectric element separating the radiating element and the planar ground element, a ground connection element on the dielectric element coupled to the first end of the radiating element for coupling the radiating element to the planar ground element, a feeder element on the dielectric element coupled to the first end of the radiating element for transferring electromagnetic radiation. The radiating element is arranged three-dimensionally on the dielectric element for forming an electrically conductive three-dimensional structure.

26 Claims, 3 Drawing Sheets

U.S. PATENT DOCUMENTS

| | | | | |
|---|---|---|---|---|
| 6,252,554 | B1 | 6/2001 | Isohatala et al. | |
| 6,314,275 | B1 | 11/2001 | Pedersen et al. | |
| 6,380,905 | B1 | 4/2002 | Annamaa et al. | |
| 6,414,637 | B2 | 7/2002 | Keilen | |
| 6,417,817 | B1 | 7/2002 | Pirila et al. | |
| 6,452,558 | B1 | 9/2002 | Saitou et al. | |
| 6,535,170 | B2 | 3/2003 | Sawamura et al. | |
| 6,549,169 | B1 | 4/2003 | Matsuyoshi et al. | |
| 6,552,685 | B2 * | 4/2003 | Zhang | 343/700 MS |
| 6,567,048 | B2 | 5/2003 | McKinzie, III et al. | |
| 6,573,867 | B1 | 6/2003 | Desclos et al. | |
| 6,624,788 | B2 | 9/2003 | Boyle | |
| 6,639,560 | B1 | 10/2003 | Kadambi et al. | |
| 6,670,923 | B1 | 12/2003 | Kadambi et al. | |
| 6,674,411 | B2 | 1/2004 | Boyle | |
| 6,693,594 | B2 | 2/2004 | Pankinaho et al. | |
| 6,714,162 | B1 | 3/2004 | Kadambi et al. | |
| 6,781,547 | B2 | 8/2004 | Lee | |
| 6,798,382 | B2 | 9/2004 | Edimo et al. | |
| 6,801,166 | B2 | 10/2004 | Mikkola et al. | |
| 6,831,607 | B2 | 12/2004 | Hebron et al. | |
| 6,911,945 | B2 | 6/2005 | Korva | |
| 6,992,627 | B1 | 1/2006 | Honda et al. | |
| 7,019,707 | B2 * | 3/2006 | Gottwald et al. | 343/786 |
| 7,038,622 | B2 | 5/2006 | Schmidt et al. | |
| 7,043,285 | B2 | 5/2006 | Boyle | |
| 7,058,434 | B2 | 6/2006 | Wang et al. | |
| 7,071,889 | B2 | 7/2006 | McKinzie, III et al. | |
| 7,079,077 | B2 | 7/2006 | Lee | |
| 7,088,290 | B2 | 8/2006 | Ohno et al. | |
| 7,161,555 | B2 | 1/2007 | Ohno et al. | |
| 7,183,982 | B2 | 2/2007 | Kadambi et al. | |
| 7,342,540 | B2 | 3/2008 | Nahar et al. | |
| 7,391,378 | B2 | 6/2008 | Mikkola et al. | |
| 7,443,344 | B2 | 10/2008 | Boyle | |
| 7,444,734 | B2 | 11/2008 | Gaucher et al. | |
| 2003/0174092 | A1 | 9/2003 | Sullivan et al. | |
| 2004/0021605 | A1 | 2/2004 | Kouam et al. | |
| 2004/0228665 | A1 | 11/2004 | Tomatsu | |
| 2005/0110693 | A1 | 5/2005 | Ryu | |
| 2007/0152885 | A1 * | 7/2007 | Sorvala | 343/700 MS |
| 2008/0100511 | A1 * | 5/2008 | Stutzke | 343/700 MS |

OTHER PUBLICATIONS

Ali et al., A uniquely packaged internal inverted-F antenna for Bluetooth or wireless LAN application, IEEE Antennas and Wireless Propagation Letters, vol. 1, 2002, p. 5-7.

Ammann, Loaded inverted F-antenna for mobile handsets, Microwave and Optical Technology Letters, vol. 28, No. 4, Feb. 20 2001, p. 226-228.

Chao et al., Three-dimensional performance of an LMS adaptive array with inverted-F elements, IEEE Transactions on Vehicular Technology, vol. 40, No. 3, Aug. 1991, p. 575-583.

Chen et al., Broadband planar inverted-L antennas, IEEE Proc.-Microw. Antennas Propag., vol. 148, No. 5, Oct. 2001, p. 339-342.

Chen et al., PIFA for GSM/DCS/PCS triple-band mobile phone, IEEE Antennas and Propagation Society International Symposium, vol. 4, Jun. 16-21, 2002, p. 528-531.

Chen et al., PIFA with a meandered and folded patch for the dual-band mobile phone application, IEEE Transactions on Antennas and Propagation, Sep. 2003, vol. 51, Issue 9, p. 2468-2471.

Ellis et al., Active planar inverted-F antennas for wireless applications, IEEE Transactions on Antennas and Propagation, vol. 51, No. 10, Oct. 2003, p. 2899-2906.

Guterman et al., Triple-band miniaturized fractal planar inverted-F antenna for a small mobile terminal, Microwaves, Radar and Wireless Communications, 2004, MIKON-2000, 15$^{th}$ International Conference, vol. 1, May 17-19 2004, p. 359-362.

Hira et al., Radiation characteristics of planar inverted F antennas with a slit, Technology Reports of the Osaka University, vol. 46, No. 2239, Apr. 1996, p. 55-60.

Hwang et al., Planar inverted F antenna loaded with high permittivity material, Electronic Letters, vol. 31, No. 20, Sep. 28, 1995, p. 1710-1712.

Kuo et al., Coplanar waveguide-fed folded inverted-F antenna for UNTS application, Microwave and Optical Technology Letters, vol. 32, No. 5, Mar. 5, 2002, p. 364-366.

Mason et al., 3-D constrained lens beamformer for planar arrays, IEE Colloquium, London, Nov. 21, 1989, Digest No. 1989/135, p. 8/1-8/7.

Moon et al., Compact PIFA for 2.4/5 GHz dual ISM-band applications, IEEE Electronics Letters, vol. 40, No. 14, Jul. 8, 2004, 2 pages.

Piper et al., Modeling the effect of 3D conformity on single and multi-band patch antennas, IEEE, 2003, p. 116-119.

Row, Experimental studies of the dual-band planar inverted-F antennas with a U-shaped slot, Microwave and Optical Technology Letters, vol. 37, No. 5, Jun. 5, 2003, p. 359-361.

Song et al., Triple-band planar inverted F antenna, IEEE, 1999, p. 908-911.

Song et al., Triple band planar inverted F antennas for handheld devices, Electronic Letters, vol. 36, No. 2, Jan. 20, 2000, p. 112-114.

* cited by examiner

ANTENNA ARRANGEMENT AND METHOD FOR MAKING THE SAME

CROSS-REFERENCE TO RELATED APPLICATIONS

This application is a continuation of application Ser. No. 10/878,239 filed on Jun. 28, 2004, to issue as U.S. Pat. No. 7,372,411 on May 13, 2008, the content of which is incorporated herein by reference in its entirety.

BACKGROUND OF THE INVENTION

1. Field of the invention

The invention relates to an antenna arrangement, to a method of making an antenna arrangement, and especially to antenna arrangements operating on microwave, millimeter wave or radio frequency ranges.

2. Description of the Related Art

WLAN (Wireless Local Area Network), Bluetooth and other LPRF (Low Power Radio Frequency) systems are often included in different product concepts of various communications devices. Since small sizes of different products are oftentimes one of the main targets in mobile phone design, implementing a high-quality LPRF antenna in mobile phones has become a major challenge.

A traditional way of designing an LPRF antenna is to use an IFA (Inverted-F Antenna) structure. In IFA, a radiator plane is connected both to the signal and the ground. Although the IFA solution makes it possible to make small-sized antennas and it can be implemented using a PWB (printed circuit board) itself, it can still lead to problems when mobile gadgets are very small and the LPRF antenna area on the PWB is limited. Thus, there often exists a lack of area when designing high-quality IFA LPRF antennas.

SUMMARY

According to an aspect of the invention, there is provided an inverted-F antenna arrangement comprising a dielectric element structure; a radiating element on the dielectric element, the radiating element having a first end and a second end; a planar ground element, the dielectric element separating the radiating element and the planar ground element; a ground connection element on the dielectric element coupled to the first end of the radiating element for coupling the radiating element to the planar ground element; a feeder element on the dielectric element coupled to the first end of the radiating element for transferring electromagnetic radiation. The radiating element is arranged three-dimensionally on the dielectric element for forming an electrically conductive three-dimensional structure.

According to an embodiment of the invention, there is provided an inverted-F antenna arrangement comprising a dielectric element having an upper surface and a lower surface perpendicular to the upper surface; a radiating element arranged on the dielectric element, the radiating element having a first end and a second end; a planar ground element, the dielectric element separating the radiating element and the planar ground element; a ground connection element on the dielectric element coupled to the first end of the radiating element for coupling the radiating element to the planar ground element; a feeder element on the dielectric element coupled to the first end of the radiating element for transferring electromagnetic radiation. The radiating element is arranged on both the upper surface and the lower surface, two or more conductive vias are formed through the dielectric element and between the upper surface and the lower surface for connecting the parts of the radiating element on the upper surface and the lower surface for forming an electrically conductive three-dimensional structure.

According to another embodiment of the invention, there is provided an inverted-F antenna arrangement comprising a dielectric element of a structure having at least two outer faces of dielectric material and two open faces opposing each other; a radiating element on the dielectric element, the radiating element having a first end and a second end; a ground connection element on the dielectric element coupled to the first end of the radiating element for coupling the radiating element to the ground; a feeder element on the dielectric element coupled to the first end of the radiating element for transferring electromagnetic radiation. The radiating element is arranged three-dimensionally on at least one of the outer faces for forming an electrically conductive three-dimensional structure.

According to another embodiment of the invention, there is provided a method of making an inverted-F antenna arrangement, the method comprising: providing a dielectric element structure; assembling a radiating element on the dielectric element, the radiating element having a first end and a second end; providing a ground element, the dielectric element separating the radiating element and the ground element; coupling a ground connection element to the first end of the radiating element for coupling the radiating element to the ground; coupling a feeder element to the first end of the radiating element for transferring electromagnetic radiation. The method further comprises arranging the radiating element three-dimensionally on the dielectric element for forming an electrically conductive three-dimensional structure.

The embodiments of the invention provide several advantages. A small-sized integrated antenna with high gain is achieved. The size of the antenna is decreased and the area required for the antenna becomes significantly smaller. Further, longer effective antenna length and better performance is achieved.

BRIEF DESCRIPTION OF THE DRAWINGS

In the following, the invention will be described in greater detail with reference to the preferred embodiments and the accompanying drawings, in which.

DETAILED DESCRIPTION OF THE ILLUSTRATED EMBODIMENTS

Figure 1A:
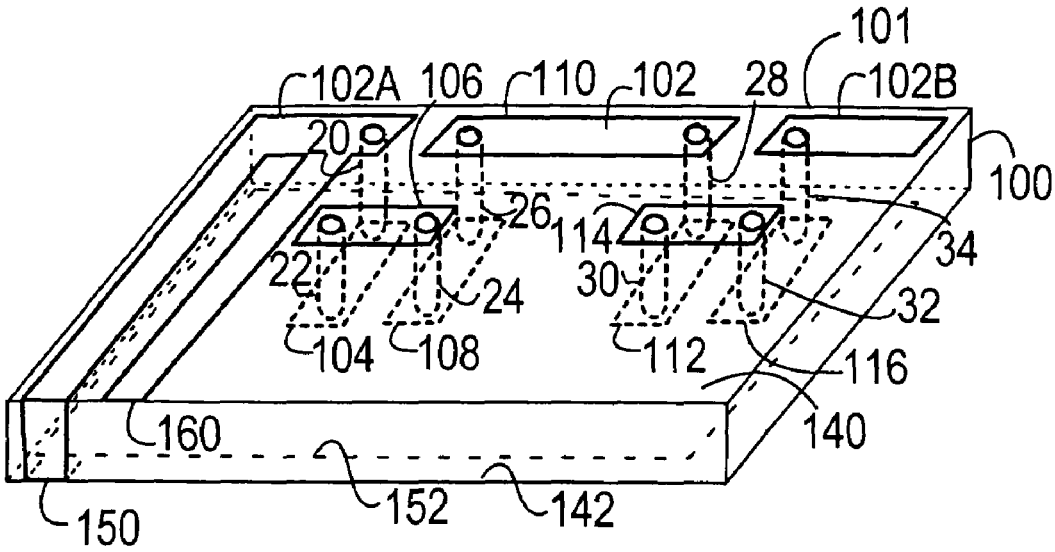
FIG. 1A is a perspective view of an antenna arrangement.

With reference to FIG. 1A, there is shown a perspective view of an antenna arrangement according to an embodiment of the invention. The embodiments described next are, however, not restricted to these antenna arrangements described only by way of example, but a person skilled in the art can also apply the instructions to other antenna arrangements containing corresponding characteristics.

The inverted-F antenna arrangement of FIG. 1A comprises a dielectric element structure 100, a radiating element 102 on the dielectric element 100, a planar ground element 152, a ground connection element 150 coupled to the radiating element 102 and a feeder element 160 coupled to the radiating element 102 for transferring electromagnetic radiation. The dielectric element 100 is, for example, a printed circuit board (PWB) made of dielectric material. The size of the printed circuit board is, for example, 40 mm×72 mm. The dielectric element 100 has, for example, a multilayer structure although, for the sake of clarity, it is illustrated as having a single layer of dielectric material in FIG. 1A. The ground connection element 150 and the feeder element 160 are coupled to the first end 102A of the radiating element 102. The ground connection element 150 is for coupling the radiating element 102 to the planar ground element 152, and the feeder element 160 conveys power from a transmitter at some distance from the radiating element 102, or from the antenna arrangement in receive mode to a receiver also at some distance from the antenna structure. The planar ground element 152 is separated by the dielectric element 100 from the radiating element 102.

The dielectric element 100 comprises an upper surface 140 and one or more lower surfaces 142 perpendicular to the upper surface 140, and the radiating element 102 is arranged three-dimensionally on the dielectric element 100. In an embodiment of FIG. 1A, this is realised by arranging the radiating element 102 on both the upper and lower surfaces 140, 142. Thus, given parts of the radiating element 102 are arranged on the upper surface 140 of the dielectric element 100, and some other parts of the radiating element 102 are arranged on one or more lower surfaces 142 of the dielectric element 100. In the situation of FIG. 1A, the first end 102A, the second end 102B and given other parts 106, 110, 114 of the radiating element 102 are on the upper surface 140, and some other parts 104, 108, 112, 116 of the radiating element 102 are on a lower surface 142. It is possible that the parts 104, 108, 112, 116 of the radiating element 102 on a surface other than the upper surface 140 are situated on more than one lower surfaces of the dielectric element 100. Thus, the lower surface 142 may mean several lower surfaces in this example.

In an embodiment, two or more conductive vias 20, 22, 24, 26, 28, 30, 32, 34 are formed through the dielectric element 100 and between the upper and lower surfaces 140, 142 for connecting the parts of the radiating element 102 on the different surfaces 140, 142. In FIG. 1A, the vias 20, 22, 24, 26, 28, 30, 32, 34 through the dielectric element 100, and the parts of the radiating element 102 on a lower surface 142 are illustrated with dashed lines. The radiating element 100 may be in the form of successive branches, the branches comprising at least diverging areas 104, 112 and returning areas 108, 116, and at least part of each branch being on another surface 140, 142 of the dielectric element 100 than where some other part of the same branch is. In this example, diverging areas refer to the areas that are diverging in relation to an upper edge 101 of the dielectric element 100, and returning areas refer to the areas that are approaching in relation to an upper edge 101 of the dielectric element 100. In an embodiment, the branches further comprise turning areas 106, 110, 114 between the diverging areas 104, 112 and the returning areas 108, 116. The turning areas 106, 110, 114 are arranged on another surface of the dielectric element 100 than where the diverging areas 104, 112 and the returning areas 108, 116 are. In this example, the turning areas 106 are parallel to the first end 102A and to the second end 102B of the radiating element 102.

In FIG. 1A, the first branch of the radiating element 100 comprises a diverging area 104, which is on a lower surface 142. The diverging area 104 is connected to the first end 102A of the radiating element 102 by means of via 20. The diverging area 104 is connected to a turning area 106 of the first branch by means of via 22. The turning area 106 is on the upper surface 140 of the dielectric element 100. The first branch of the radiating element 100 further comprises a returning area 108 on the lower surface 142, which returning area 108 is connected to the turning area 106 by means of via 24. The returning area 108 is also the first part of the second branch in this example. The returning area 108 of the second branch is connected to a turning area 110 of the second branch on the upper surface 140 by means of via 26. The turning area 110 is further connected to a diverging area 112 of the second branch on the lower surface 142 by means of via 28. The diverging area 112 is also the first part of the third branch in this example. The diverging area 112 of the third branch is then connected to a turning area 114 of the third branch on the upper surface 140 by means of via 30. The turning area 114 is further connected to a returning area 116 of the third branch on the lower surface 142 by means of via 32. Finally, the returning area 116 is connected to the second end 102B of the radiating element 102 on the upper surface 140. A size reduction of the antenna arrangement in this embodiment may be about 25% compared to a situation where the radiating element 102 is not arranged three-dimensionally on the dielectric element 100.

It is also possible that the successive branches form different shapes than in this example. The branches may be, for example, in a wave-like form. The radiating element 102 in this example has a rectangular structure. However, it is possible that the radiating element 102 has some other structure as well. The number of successive branches, and thus, the length of the radiating element 102 may also vary. The length of the radiating element 102, and the distance between the radiating element 102 and the ground determine the antenna characteristics. Thus, the length of the radiating element 102 may be adjusted according to current needs. Also, the width of the radiating element 102 may vary.

Figure 1B:
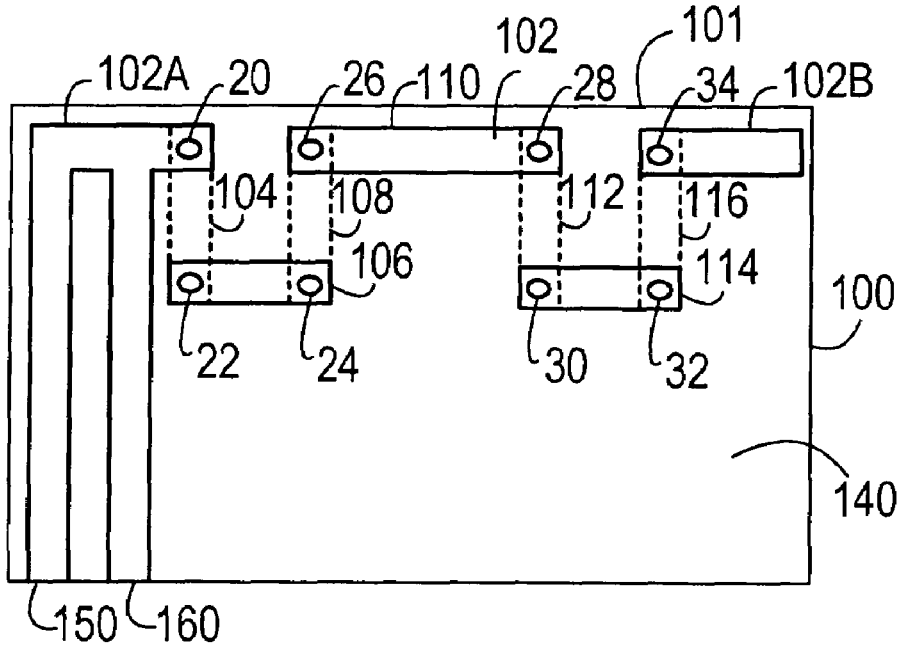
FIG. 1B is a top view of an antenna arrangement.

FIG. 1B shows a top view of an antenna arrangement of FIG. 1A. The inverted-F antenna arrangement comprises a dielectric element structure 100, of which only the upper surface 140 is visible in FIG. 1B. The radiating element 102 is arranged three-dimensionally on the dielectric element 100, and the parts of the dielectric element 100 on the lower surface (not shown) 104, 108, 112, 116 of the radiating element 102 are illustrated with dashed lines. A ground connection element 150 and a feeder element 160 are connected to the first end 102A of the radiating element 102.

From the top view of FIG. 1B it can be seen that the radiating element 102 is, in fact, in the form of a meandering antenna. The radiating element 102 is arranged in the form of successive braches, and at least part of each branch is on another surface of the dielectric element 100 than where some other part of the same branch is. The antenna arrangement further comprises conductive vias 20, 22, 24, 26, 28, 30, 32, 34 that are formed through the dielectric element 100 and between the upper and lower surfaces for connecting the parts of the radiating element 102.

In the same way as in FIG. 1A, the first end 102A of the radiating element, diverging areas 104, 112, returning areas 108, 116, turning areas 106, 110, 114 and the second end 102B of the radiating element 102 are connected through conductive vias 20, 22, 24, 26, 28, 30, 32, 34, and thus form a meandering radiating line structure. Although in the examples of FIGS. 1A and 1B, both the ground connection element 150 and the feeder element 160 are on the upper surface 140 of the dielectric element 100, they may also be in one or more lower surfaces of the dielectric element 100, and then connected through vias to the first end 102A of the radiating element 102, for example.

Figure 2A:
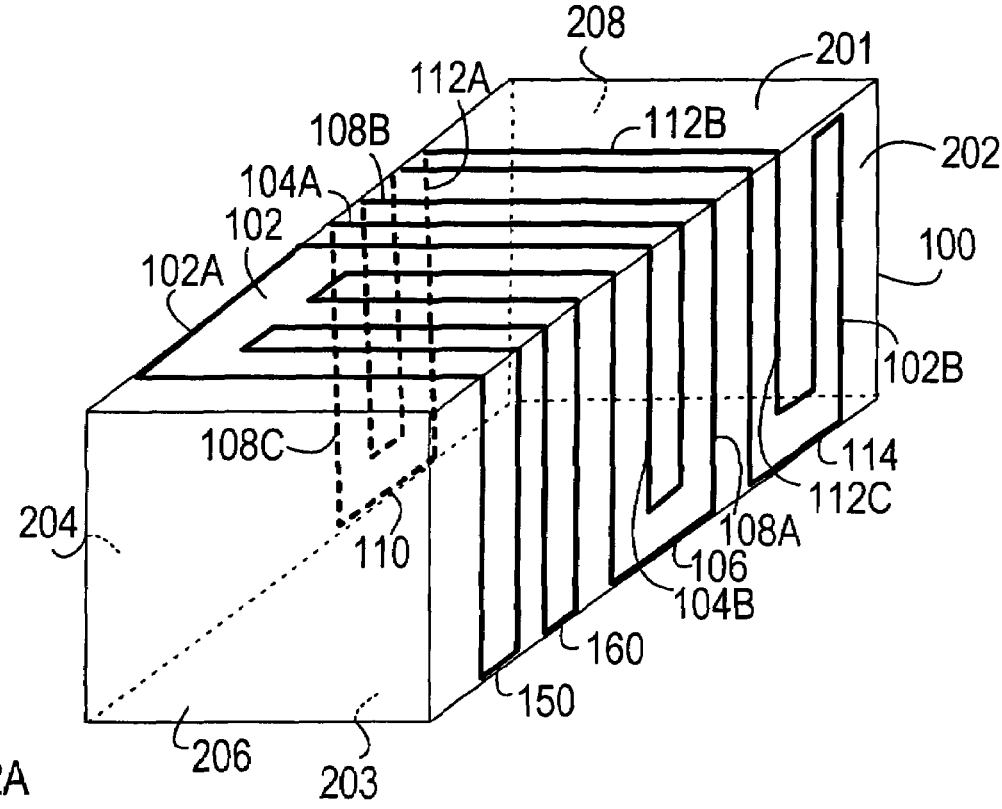
FIG. 2A is a perspective view of an antenna arrangement.
Figure 2B:
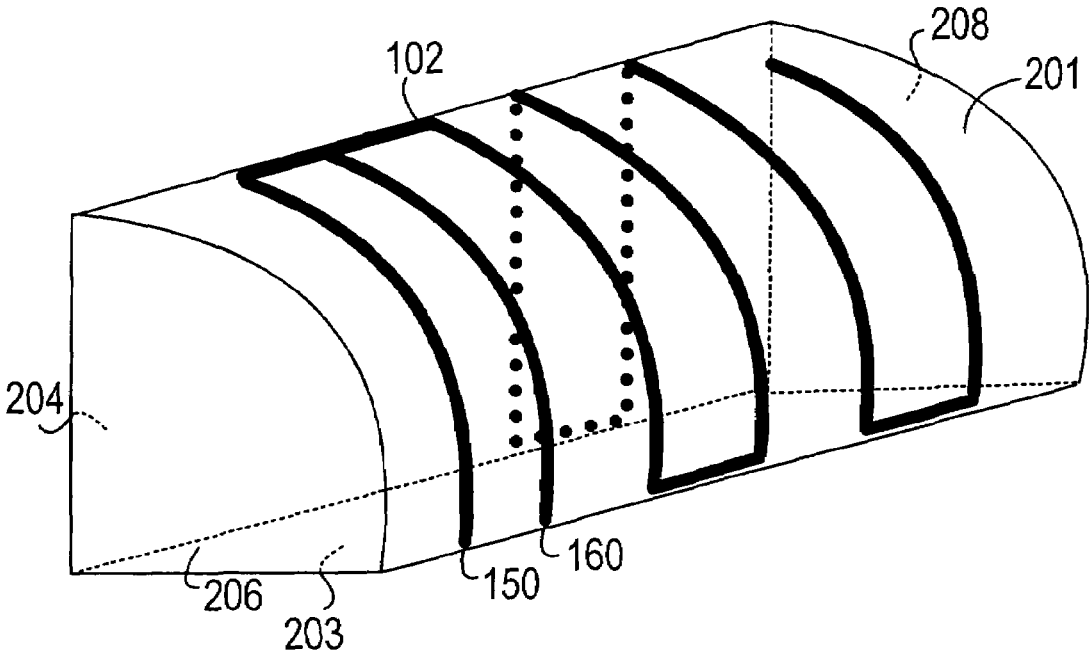
FIGS. 2B and 2C are other perspective views of antenna arrangements.
Figure 2C:
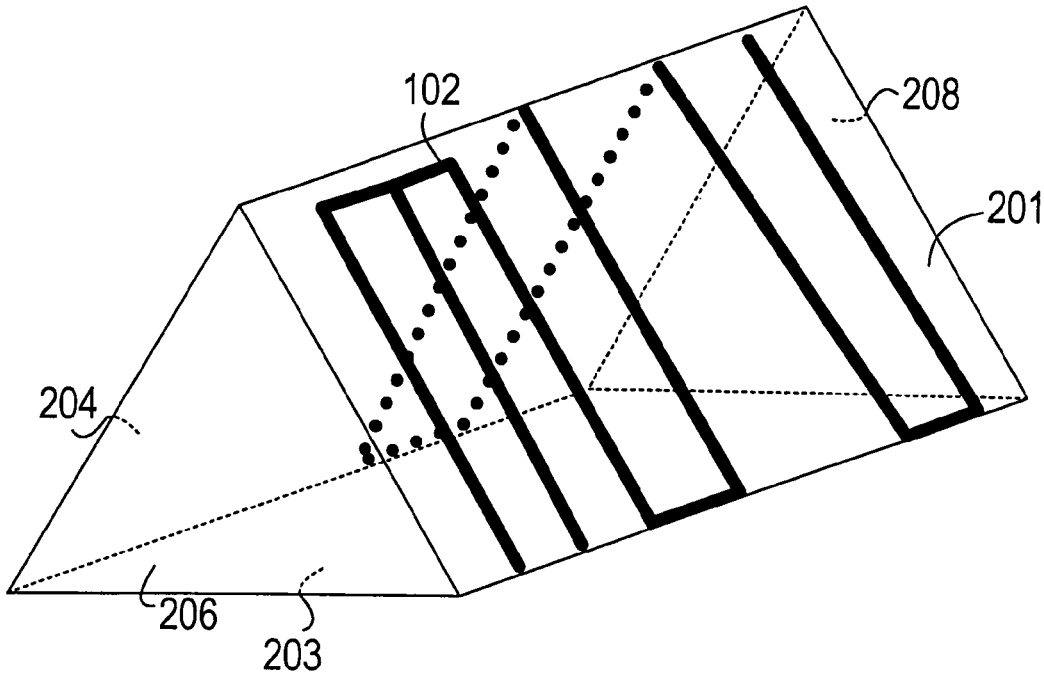

FIGS. 2A, 2B and 2C show perspective views of antenna arrangements according to embodiments of the invention.

The antenna arrangement comprises a dielectric element 100 of a structure having at least two outer faces 201, 202, 203, 204 of dielectric material and two open faces 206, 208 opposite to each other. The antenna arrangement further comprises a radiating element 102, a ground connection element 150 and a feeder element 160. The radiating element 102 is arranged three-dimensionally on at least one of the outer faces 201, 202, 203, 204 of the dielectric element 100, and thus, a three-dimensional radiating element 102 structure is formed.

The space inside the dielectric element structure is filled with air, for example. The dielectric element 100 may be made of ceramics, or of other suitable dielectric materials. The radiating element 102, ground connection element 150 and feeder element 160 may be arranged on the dielectric element 100 by using an adhesive tape, for example.

In an embodiment, the radiating element 102 is in the form of successive branches, the branches comprising diverging areas 104A, 104B, 108C, 112B, 112C, and returning areas 108A, 108B, 112A, 102B. In this example, diverging areas refer to the areas that are diverging in relation to the first end 102A of the radiating element 102, and returning areas refer to the areas that are approaching in relation to the first end 102A. In an embodiment, the branches further comprise turning areas 106, 110, 114 that are parallel to the first end 102A, for example, and connect the diverging areas and returning areas.

In an embodiment of FIG. 2A, the dielectric element 100 has a box-like structure having four outer faces 201, 202, 203, 204 and two open faces 206, 208 opposite to each other, and the radiating element 102 is arranged on at least two of the four outer faces 201, 202, 203, 204. In another embodiment, at least one outer face 201, 202, 203, 204 of the dielectric element 100 is a curved face, and at least part of the radiating element is arranged on the curved face. The dielectric element 100 may have different shapes, such as a triangle, a box, a cylinder, a pentagon or a combination thereof, according to embodiments of the invention. The different shapes may be implemented by using different number of outer faces 201, 202, 203, 204 and/or different shapes of the outer faces 201, 202, 203, 204.

In FIG. 2A, the ground connection element 150 and the feeder element 160 are on the outer faces 201 and 202. The diverging area 104A of the radiating element 102 is on the outer face 201. From the diverging area 104A the radiating element 102 continues as a diverging area 104B that is on the outer face 202. The turning area 106 is on the outer face 202 and between the diverging area 104B and a returning area 108A on the outer face 202. The radiating element 102 continues from the returning area 108A as a returning area 108B that is on the outer face 201. Next, the radiating element 102 continues to the outer face 204 as a diverging area 108C. The turning area 110 is on the outer face 204, and between the diverging area 108C and a returning area 112A. The radiating element 102 continues back to the outer face 201 as a diverging area 112B, and then to the outer face 202 as a diverging area 112C. The turning area 114 on the outer surface 202 is between the diverging area 112C and the second end 102B of the radiating element 102. Thus, in this example, the radiating element 102 is arranged on three outer surfaces 201, 202 and 204 of the dielectric element 100. The length of the radiating element 102 may be further adjusted according to the requirements of the antenna arrangement.

In an embodiment of FIG. 2B, an antenna arrangement with a dielectric element 100 having three outer faces 201, 203 and 204 and two open faces 206, 208 is shown. One of the three outer faces in this embodiment is a curved face 201. The ground connection element 150 and the feeder element 160 are arranged on the curved outer face 201 in this example. The radiating element 102 is arranged partly on the curved outer face 201 and partly on another outer face 204.

In an embodiment of FIG. 2C, the dielectric element 100 has three outer faces 201, 203, 204 and two open faces 206, 208 opposite to each other, thus forming a triangular structure, and the radiating element 102 is arranged on two of the three outer faces 201, 204.

Figure 3:
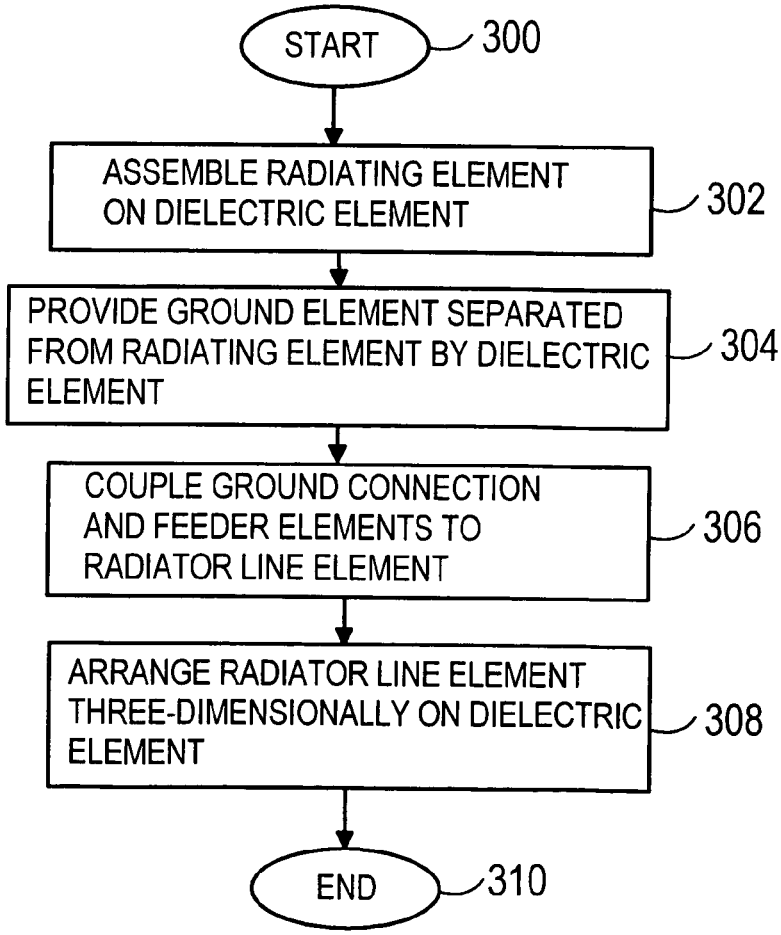
FIG. 3 describes a method of making an antenna arrangement.

FIG. 3 illustrates a method of making an inverted-F antenna arrangement. The method starts in 300. In 302, a radiating element is assembled on a dielectric element, the radiating element having a first end and a second end. In 304, a ground element is provided for the arrangement, the dielectric element separating the radiating element and the ground element. In 306, a ground connection element is coupled to the first end of the radiating element for coupling the radiating element to the ground, and a feeder element is coupled to the first end of the radiating element for transferring electromagnetic radiation.

In 308, the radiating element is arranged three-dimensionally on the dielectric element. The radiating element may be arranged three-dimensionally on the dielectric element, for example, by arranging the radiating element on both an upper surface and a lower surface of the dielectric element. Also, two or more conductive vias may be formed through the dielectric element and between the upper and the lower surfaces for connecting the parts of the radiating element on the upper surface and the lower surface. The dielectric element may also be a box-like structure having four outer faces of dielectric material and two open faces opposing each other, and the radiating element is arranged on at least two of the four outer faces of the dielectric element. Further, an adhesive tape may be used in assembling the radiating element on the outer faces of the dielectric element, for example. The method ends in 310.

Even though the invention is described above with reference to an example according to the accompanying drawings, it is clear that the invention is not restricted thereto but it can be modified in several ways within the scope of the appended claims.

What is claimed is:

1. An inverted-F antenna arrangement comprising:

a dielectric element structure;

a radiating element having a surface adjacent to and in surface contact with the dielectric element, the radiating element having a first end and a second end;

a planar ground element;

a ground connection element on the dielectric element coupled to the first end of the radiating element for coupling the radiating element to the planar ground element;

a feeder element on the dielectric element coupled to the first end of the radiating element for transferring electromagnetic radiation, wherein:

the radiating element is arranged three-dimensionally on the dielectric element for forming an electrically conductive three-dimensional structure.

2. The antenna arrangement of claim 1, wherein the dielectric element comprises an upper surface and one or more lower surfaces, and the radiating element is arranged on both the upper surface and on one or more lower surfaces.

3. The antenna arrangement of claim 2, wherein two or more conductors are provided between the upper and lower surfaces for connecting the parts of the radiating element on the upper and lower surfaces.

4. The antenna arrangement of claim 2, wherein the radiating element is in the form of successive branches, the branches comprising at least a diverging area and a returning area, and at least part of each branch is on another surface of the dielectric element than where some other part of the same branch is.

5. The antenna arrangement of claim 4, the branches further comprising turning areas between the diverging areas and the returning areas, and the turning areas being arranged on other surfaces of the dielectric element than where the diverging areas and the returning areas are.

6. The antenna arrangement of claim 5, wherein the turning area is arranged on an upper surface of the dielectric element and the returning area and the diverging area are arranged on a lower surface of the dielectric element.

7. The antenna arrangement of claim 1, wherein the dielectric element is a structure having an outer face of dielectric material and two open faces opposite to each other, and the radiating element is arranged on the outer face.

8. The antenna arrangement of claim 7, wherein the outer face has a cylindrical structure.

9. The antenna arrangement of claim 1, wherein the dielectric element is a structure having at least two outer faces of dielectric material and two open faces opposite to each other, and the radiating element is arranged on at least one of the outer faces.

10. The antenna arrangement of claim 9, wherein the radiating element on at least one of the outer faces is in the form of successive branches, the branches comprising at least a diverging area and a returning area.

11. The antenna arrangement of claim 1, wherein the dielectric element comprises at least one curved face and at least part of the radiating element is arranged on the curved face.

12. An inverted-F antenna arrangement comprising:

a dielectric element having an upper surface and a lower surface parallel to the upper surface;

a radiating element arranged on the dielectric element, the radiating element having a first end and a second end;

a planar ground element;

a ground connection element on the dielectric element coupled to the first end of the radiating element for coupling the radiating element to the planar ground element;

a feeder element on the dielectric element coupled to the first end of the radiating element for transferring electromagnetic radiation;

two or more conductors; and wherein the radiating element is arranged on both the upper surface and the lower surface, and the two or more conductors are disposed between the upper surface and the lower surface for connecting the parts of the radiating element on the upper surface and the lower surface for forming an electrically conductive three-dimensional radiating element.

13. An apparatus comprising:

a communications device; and an antenna arrangement integrally coupled to the communications device, the antenna arrangement comprising:

a dielectric element structure;

a radiating element having a surface adjacent to and in surface contact with the dielectric element, the radiating element having a first end and a second end;

a planar ground element;

a ground connection element on the dielectric element coupled to the first end of the radiating element for coupling the radiating element to the planar ground element;

a feeder element on the dielectric element coupled to the first end of the radiating element for transferring electromagnetic radiation; and wherein the radiating element is arranged three-dimensionally on the dielectric element for forming an electrically conductive three-dimensional structure.

14. The apparatus as in claim 13, wherein the communications device comprises a mobile phone.

15. An apparatus comprising:

a dielectric comprising an air gap separating at least two faces of the dielectric;

a radiating element having a plurality of radiating element portions, wherein a plurality of the radiating element portions are disposed along and separated by the at least two faces of the dielectric;

a plurality of conductors coupling the plurality of separated radiating element portions separated through the dielectric; and a ground connection element that conductively couples one end of the radiating element to a ground, wherein the ground connection element is disposed along a selected one of the faces of the dielectric with at least one of the radiating element portions.

16. The apparatus of claim 15, further comprising a feeder element coupled to the radiating element for transferring electromagnetic radiation, wherein the feeder element is disposed on the selected face of the dielectric.

17. The apparatus of claim 15, further comprising:

a transmitter; and a feeder element coupled to the radiating element and coupled to the transmitter and configured to convey electromagnetic signals therefrom.

18. The apparatus of claim 15, further comprising:

a feeder element coupled to the radiating element and configured to receive electromagnetic signals; and a receiver coupled to the feeder element to receive the electromagnetic signals.

19. The apparatus of claim 15, wherein the radiating element portions and the plurality of conductors collectively comprise a three-dimensional radiating element about the dielectric.

20. The apparatus of claim 15, wherein the dielectric comprises at least one curved face and at least part of the radiating element is arranged on the curved face.

21. The apparatus of claim 15, wherein the dielectric comprises at least three faces and at least part of the radiating element is arranged on the at least three faces.

22. The apparatus of claim 16, wherein the dielectric comprises a first and second face, and wherein the feeder element is disposed on the first face and a selected one of the radiating portions is disposed on the second face, and wherein at least a portion of the feeder element and at least a portion of the selected radiating portion are oriented in respective parallel planes.

23. The apparatus of claim 16, wherein the dielectric is a box-like structure.

24. A method comprising:

forming a first plurality of radiating element segments on a first layer of a dielectric element;

forming a second plurality of radiating element segments on one or more second layer of the dielectric element;

forming a unified radiating element by electrically coupling the first plurality of radiating element segments to the second plurality of radiating element segments between the first and second layers of the dielectric, wherein an air gap exists between the first and second layers of the dielectric; and forming a ground connection element disposed along a selected one of the first and second layers of the dielectric with at least one of the first and second radiating element segments, wherein the ground connection element conductively couples one end of the unified radiating element to a ground.

25. The method of claim 24, further comprising electrically coupling a feeder element to one of the first plurality of radiating element segments, and transmitting electromagnetic signals via the feeder element, and disposing the feeder element on the selected face of the dielectric.

26. The method of claim 24, further comprising electrically coupling a feeder element to one of the first plurality of radiating element segments, and receiving electromagnetic signals via the feeder element.

* * * * *